United States Patent [19]

Nakamura

[11] Patent Number: 4,962,017

[45] Date of Patent: Oct. 9, 1990

[54] SILVER HALIDE PHOTOGRAPHIC MATERIALS

[75] Inventor: Koki Nakamura, Kanagawa, Japan

[73] Assignee: Fuji Photo Film Co., Ltd., Kanagawa, Japan

[21] Appl. No.: 175,374

[22] Filed: Mar. 30, 1988

[30] Foreign Application Priority Data

Mar. 30, 1987 [JP] Japan ..... 62-76585

[51] Int. Cl.[5] ..... G03C 1/33; G03C 1/34

[52] U.S. Cl. ..... 430/551; 430/606; 430/607; 430/613; 430/614

[58] Field of Search ..... 430/551, 606, 607, 613, 430/614

[56] References Cited

U.S. PATENT DOCUMENTS

| | | | |
|---|---|---|---|
| 3,881,939 | 5/1975 | Noda et al. | 430/613 |
| 4,245,033 | 1/1981 | Eida et al. | 430/614 |
| 4,460,682 | 7/1984 | Mizukura et al. | 430/551 |
| 4,490,460 | 12/1984 | Shimba et al. | 430/551 |
| 4,554,243 | 11/1985 | Ono et al. | 430/614 |
| 4,734,353 | 3/1988 | Ono et al. | 430/607 |
| 4,783,396 | 11/1988 | Nakamura et al. | 430/353 |

FOREIGN PATENT DOCUMENTS 187850 8/1987 Japan .

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A compound of the general formula (I):

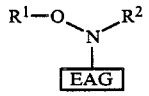

(I)

(in which EAG represents an electron accepting group; $R^1$ and $R^2$ each represents a substituent except hydrogen; and $R^1$ and $R^2$, $R^1$ and EAG, and $R^2$ and EAG may be bonded together to form a ring) is incorporated into a silver halide photographic material. The compound of the formula (I) becomes oxidative after cleavage of the nitrogen-oxygen single bond in the molecule, and the compound displays an action as an antifoggant, a stabilizer and/or a black spot preventing agent in the photographic material.

14 Claims, No Drawings

SILVER HALIDE PHOTOGRAPHIC MATERIALS

FIELD OF THE INVENTION

The present invention relates to silver halide photographic materials and, in particular, to those containing a new compound which becomes oxidative through cleavage of the single bond between nitrogen and oxygen in the compound

BACKGROUND OF THE INVENTION

Numerous oxidizing organic compounds which are present in photographic elements are known, including, for example, quinones, anthraquinones, nitro compounds, tetrazolium compounds, phenazine derivatives, phenazine oxide derivatives, bipyridyl quaternary salt derivatives, etc. These are described, for example, in Japanese Patent Application (OPI) No. 45718/74 (the term "OPI" as used herein refers to a "published unexamined Japanese patent application"), British Patent No. 956,277, U.S. Pat. Nos. 3,449,122 and 3,396,023, Japanese Patent Application (OPI) No. 64839/84, West German Patent Application (OLS) No. 2,734,335, etc. These oxidizing compounds are in most cases used as an antifoggant, desensitizer, contrast enhancer, etc. In preparation of silver halide photographic materials with less fog, these known compounds are often tested widely so as to obtain the intended photographic characteristic. The reason is as follows: Even the same oxidizing compound displays an extremely different effect when the formulation of the silver halide emulsion containing the oxidizing compound differs, and so it is seldom that the intended object could be attained. Moreover, even if the intended object could be attained, the compound incorporated into the material would often have various problematic properties that the compound would be rendered unfavorable for preparation of silver halide photographic materials. Often the compound has adverse side effects to the photographic characteristics (for example, noticeable desensitization). The compound frequently has an adverse influence on the storability. Another problem is that the compound can cause coloration or staining of the material. Often the compound, which is dissolved in the developer used for processing the material, precipitates out of solution, and the resulting precipitate has a harmful influence on the developer.

Moreover, to date there is much that is unknown about these oxidizing compounds. For example, the mechanism for the object of the use of the compounds has yet to be clarified. Likewise, the relation between the physical properties of the oxidizing compounds and those of silver halide emulsions is still unclear. Thus, under the existing state of knowledge, it is still extremely difficult to determine which oxidizing compounds are effective.

A phenomenon of so-called "black spots" is known in the field of photographic light-sensitive materials for graphic arts. This phenomenon is similar to that of fog in silver halide photographic materials. The phenomenon of black spots also have various unclarified problems, and the solution of such problems has also been desired.

Because of the above-mentioned reasons, it is preferable to select oxidizing compounds capable of attaining a desired characteristic from numerous kinds of various compounds in the preparation of silver halide photographic materials. Thus, it is further preferable to determine the effect and mechanism of various oxidizing compounds in various silver halide photographic materials so that the search for more effective oxidizing compounds can be advanced.

SUMMARY OF THE INVENTION

An object of the present invention is to provide a silver halide photographic material which is almost free from fog and which exhibits excellent stability, the material being characterized by containing a novel compound which becomes oxidative through the reaction of cleaving the nitrogen-oxygen single bond of the compound.

Another object of the present invention is to provide a silver halide photographic material that is improved by being free from black spots which often adversely affect the materials for graphic arts.

The objects of the present invention are attained by incorporation of a novel compound of the following general formula (I) into a silver halide photographic material.

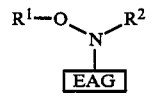

(I)

wherein EAG represents an electron accepting group; N and O each represents a nitrogen atom and an oxygen atom, respectively; $R^1$ and $R^2$ each represents a substituent except a hydrogen atom; $R^1$ and $R^2$, $R^1$ and EAG, and $R^2$ and EAG may independently be bonded together to form a ring.

The compound of general formula (I) of the present invention is one which does not release a photographically useful group. The photographically useful group as used here indicates, for example, development inhibitors, development accelerators, nucleating agents, couplers, diffusible or nondiffusible dyes, desilvering accelerators, desilvering inhibitors, silver halide solvents, competing compounds, developing agents, developing auxiliaries, fixing accelerators, fixing inhibitors, image stabilizers, toning agents, processing dependence improving agents, dot improving agents, color image stabilizers, photographic dyes, surfactants, hardeners, desensitizers, contrast intensifiers, chelating agents and fluorescent whitening agents as well as precursors thereof.

In the compounds of general formula (I), the electron accepting group is bonded to the side of the nitrogen atom nearest the nitrogen-oxygen single bond. Thus, when the EAG group has accepted an electron the nitrogen-oxygen single bond is thereby cleaved, so that the compound irreversibly becomes oxidative.

DETAILED DESCRIPTION OF THE INVENTION

The present inventors earnestly studied the cleavage reaction of a nitrogen-oxygen single bond and as a result have found that in the compound of the above-mentioned general formula (I) having the electron accepting group bonded to the nitrogen atom, the nitrogen-oxygen bond is cleaved through reduction. More advantageously, it has further been found that the reduction potential can be varied extremely broadly by variously changing the substituents of the electron accepting group. Moreover, the electron control of a more fine range became also possible by changing the substituents on the oxygen atom and/or nitrogen atom of general formula (I).

The compounds of general formula (I) are explained in detail hereunder.

$R^1$ and $R^2$ may be the same or different and each represents a substituent except hydrogen, which is preferably an alkyl group, an aryl group, a heterocyclic group, an acyl group, an alkoxycarbonyl group, a carbamoyl group, a sulfonyl group, an aryloxycarbonyl group or a sulfamoyl group, each group having up to 30 carbon atoms, preferably up to 20 carbon atoms. These groups may further be substituted by any other substituent(s).

In general, the reduction potential can be elevated when the substituent on the oxygen atom or the nitrogen atom is an electron attractive group. The substituent in the electron accepting group has the same behavior so that the reduction potential (oxidative power) is high when the electron attractive capacity of the substituent is great.

The compounds of general formula (I) can work when they are reacted with reducing substances. Compounds which are generally known as a developing agent or an auxiliary developing agent in the field of photographic light-sensitive materials, etc., can be used as the reducing substance.

The compounds of general formula (I) are dispersed by emulsification in oils or dissolved in water-soluble solvents, and the resulting dispersions or solutions are added and incorporated into photographic light-sensitive materials, or alternatively, they can, directly or in the form of a solid, be added and incorporated thereinto.

In addition to the compounds of general formula (I), other reducing, substances can also be added in the same manner, or can be introduced into the processing system in the form of a solution during or prior to the development of the photographic light-sensitive materials.

As mentioned above, a silver halide emulsion containing the compound of general formula (I) is prepared. The use of the compounds of general formula (I) is discussed hereinafter.

The compounds of general formula (I) are used as an antifoggant or as a stabilizer or a black spot-preventing agent.

Examples of compounds which can be used as a reducing substance in the present invention include inorganic reducing agents such as sulfites (e.g., sodium sulfite, sodium hydrogensulfite, etc.), silver halides, etc.; as well as benzenesulfinic acids, hydroxylamines, hydrazines, hydrazides, borane/amine complexes, hydroquinones, aminophenols, catechols, p-phenylenediamines, 3-pyrazolidinones, hydroxytetronic acid, ascorbic acid, 4-amino-5-pyrazolones, etc. In addition, the reducing agents described in T. H. James, *The Theory of the Photographic Processes,* 4th Ed., pp. 291 to 334 can also be used. Further, the reducing agent precursors described in Japanese Patent Application (OPI) Nos. 138736/81 and 40245/82 and in U.S. Pat. No. 4,330,617 can also be used.

Examples of more preferred reducing agents are as follows:

3-Pyrazolidones and precursors thereof (for example, 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)- 4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxypyrazolidone).

Hydroquinones and precursors thereof (for example, hydroquinone, toluhydroquinone, chlorohydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenol, 2-methyl-4-benzoyloxyphenol, 2-t-butyl-4-(4-chlorobenzoyloxy)phenol).

The combination of various reducing agents described in U.S. Pat. No. 3,039,869 can also be used for the photographic materials of the present invention.

Color developing agents can also be used as the reducing substance for use in the present invention. Regarding color developing agents for use in the present invention, p-phenylene series color developing agents, such as N,N-diethyl-3-methyl-p-phenylenediamine, are described in U.S. Pat. No. 3,531,286. More useful reducing agents are the aminophenols described in U.S. Pat. No. 3,761,270. Among the aminophenol reducing agents, especially useful compounds are 4-amino-2,6-dichlorophenol, 4-amino-2,6-dibromophenol, 4-amino-2-methylphenol sulfate, 4-amino-3-methylphenol sulfate, 4-amino-2,6-dichlorophenyl hydrochloride, etc. Further, *Research Disclosure*, Vol. 151, (RD No. 15108) and U.S. Pat. No. 4,021,240 describe 2,6-dichloro-4-substituted sulfonamidophenols and 2,6-dibromo-4-substituted sulfonamidophenols; and Japanese Patent Application (OPI) No. 116740/84 describes p-(N,N-dialkylaminophenyl)-sulfamines, etc., and all of them are useful for the photographic materials of the present invention. In addition to the above-mentioned phenol series reducing agents, naphthol series reducing agents, for example, 4-aminonaphthol derivatives and 4-substituted sulfonamidonaphthol derivatives, are also useful. As applicable general color developing agents, there may be mentioned, for example, the aminohydroxypyrazole derivatives described in U.S. Pat. No. 2,895,825; the aminopyrazoline derivatives described in U.S. Pat. 2,892,714; and the hydrazone derivatives described in *Research Disclosure* (RD 19412, RD 19415), pp. 227 to 230 and pp. 236 to 240 (June, 1980). These color developing agents can be used singly or in combination of two or more of them.

The compounds of general formula (I) can be allowed to react with a silver halide as a desensitizer. The above-mentioned effects are believed to result from the reaction of the compound of general formula (I) with a silver halide directly or indirectly via any other redox compound thereby to oxidize fog nuclei or latent images.

Preferably, the compounds of general formula (I) have an improved characteristic as an oxidizing agent (for example, improved reduction potential), an improved compound stability and an elevated degree of freedom for synthetic compound production, and therefore these are preferably compounds of general formula (II):

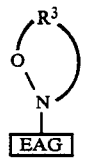

(II)

in which $R^3$ is bonded to the nitrogen atom and the oxygen atom in the formula and represents an atomic group necessary for forming a 3-membered to 8-membered mono- or condensed-heterocyclic ring; and $R^3$ may also be bonded to EAG to form a ring; and the other symbols of the formula (II) have the same meanings as in general formula (I). The representations of the substituents are mentioned in greater detail hereunder.

EAG represents a group which accepts an electron from a reducing substance. EAG is bonded to the nitrogen atom. As EAG, the groups represented by the following formula (A) or (B) are preferred:

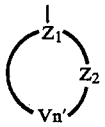

(A)

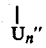

(B)

In general formula (A), $Z_1$ represents

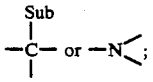

represents an atomic group for forming a 3-membered to 8-membered ring with $Z_1$ and $Z_2$; n' represents an integer of from 3 to 8, provided that $V_3$=—$Z_3$—, $V_4$=—$Z_3$—$Z_4$—, $V_5$=—$Z_3$—$Z_4$—$Z_5$—, $V_6$=—$Z_3$—$Z_4$—$Z_5$—$Z_6$—, $V_7$=—$Z_3$—$Z_4$—$Z_5$—$Z_6$—$Z_7$—, and $V_8$=—$Z_3$—$Z_4$—$Z_5$—$Z_6$—$Z_7$—$Z_8$—.

$Z_2$ to $Z_8$ each represents

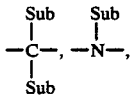

—O—, —S— or —$SO_2$—; and "Sub" represents a mere bond ($\pi$ bond), a hydrogen or a substituent as mentioned below. When "Sub" is a mere bond, $Z_2$ to $Z_8$ each represents

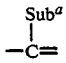

or —N= where $Sub^a$ is hydrogen or a substituent as mentioned below. Plural "Sub"'s may be the same or different or they may be bonded together to form a 3-membered to 8-membered, saturated or unsaturated, carbocyclic or heterocyclic ring. In general formula (A), "Sub"'s are so selected that the total of the Hammett's substituent constants of the substituents is +0.09 or more, preferably +0.3 or more, most preferably +0.45 or more.

Examples of "Sub" and "$Sub^a$" as substituents are mentioned below, which substituents preferably have up to 40 carbon atoms.

A substituted or unsubstituted alkyl group (e.g., a methyl group, an ethyl group, a sec-butyl group, a t-octyl group, a benzyl group, a cyclohexyl group, a chloromethyl group, a dimethylaminomethyl group, an n-hexadecyl group, a trifluoromethyl group, a 3,3,3-trichloropropyl group, a methoxycarbonylmethyl group, etc.), a substituted or unsubstituted alkenyl group (e.g., a vinyl group, a 2-chlorovinyl group, a 1-methylvinyl group, etc.), a substituted or unsubstituted alkynyl group (e.g., an ethynyl group, a 1-propynyl group, etc.), a cyano group, a nitro group, a halogen atom (e.g., a fluorine atom, a chlorine atom, a bromine atom, an iodine atom), a substituted or unsubstituted heterocyclic group (e.g., a 2-pyridyl group, a 1-imidazolyl group, a benzothiazol-2-yl group, a morpholino group, a benzoxazol-2-yl group, etc.), a sulfo group, a carboxyl group, a substituted or unsubstituted aryloxycarbonyl or alkoxycarbonyl group (e.g., a methoxycarbonyl group, an ethoxycarbonyl group, a tetradecyloxycarbonyl group, a 2-methoxyethylcarbonyl group, a phenoxycarbonyl group, a 4-cyanophenylcarbonyl group, a 2-chlorophenoxycarbonyl group, etc.), a substituted or unsubstituted carbamoyl group (e.g., a carbamoyl group, a methylcarbamoyl group, a diethylcarbamoyl group, a methylhexadecylcarbamoyl group, a methyloctadecylcarbamoyl group, a phenylcarbamoyl group, a 2,4,6-trichlorophenylcarbamoyl group, an N-ethyl-N-phenylcarbamoyl group, a 3-hexadecylsulfamoylphenylcarbamoyl group, etc.), a hydroxyl group, a substituted or unsubstituted azo group (e.g., a phenylazo group, a p-methoxyphenylazo group, a 2-cyano-4-methanesulfonylphenylazo group, etc.), a substituted or unsubstituted aryloxy group or alkoxy group (e.g., a methoxy group, an ethoxy group, a dodecyloxy group, a benzyloxy group, a phenoxy group, a 4-methoxyphenoxy group, a 3-acetylaminophenoxy group, a 3-methoxycarbonylpropyloxy group, a 2-trimethylammonioethoxy group, etc.), a sulfino group, a sulfeno group, a mercapto group, a substituted or unsubstituted acyl group (e.g., an acetyl group, a trifluoroacetyl group, an n-butyroyl group, a t-butyroyl group, a benzoyl group, a 2-carboxybenzoyl group, a 3-nitrobenzoyl group, a formyl group, etc.), a substituted or unsubstituted arylthio or alkylthio group (e.g., a methylthio group, an ethylthio group, a t-octylthio group, a hexadecylthio group, a phenylthio group, a 2,4,5-trichlorophenylthio group, a 2-methoxy-5-t-octylphenylthio group, a 2-acetylaminophenylthio group, etc.), a substituted or unsubstituted aryl group (e.g., a phenyl group, a naphthyl group, a 3-sulfophenyl group, a 4-methoxyphenyl group, a 3-lauroylaminophenyl group, etc.), a substituted or unsubstituted sulfonyl group (e.g., a methylsulfonyl group, a chloromethylsulfonyl group, an n-octylsulfonyl group, an n-hexadecylsulfonyl group, a sec-octylsulfonyl group, a p-toluenesulfonyl group, a 4-chlorophenylsulfonyl group, a 4-dodecylphenylsulfonyl group, a 4-dodecyloxyphenylsulfonyl group, a 4-nitrophenylsulfonyl group, etc.), a substituted or unsubstituted sulfinyl group (e.g., a methylsulfinyl group, a dodecylsulfinyl group, a phenylsulfinyl group, a 4-nitrophenylsulfinyl group, etc.), a substituted or unsubstituted amino group (e.g., a methylamino group, a diethylamino group, a methyloctadecylamino group, a phenylamino group, an ethylphenylamino group, a 3-tetradecylsulfamoylphenylamino group, an acetylamino group, a trifluoroacetylamino group, an N-hexadecylacetylamino group, an N-methylbenzoylamino group, a methoxycarbonylamino group, a phenoxycarbonylamino group, an N-methoxyacetylamino group, an amidinoamino group, a phenylaminocarbonylamino group, a 4-cyanophenylaminocarbonylamino group, an N-ethylethoxycarbonylamino group, an N-methyldodecylsulfonylamino group, an N-(2-cyanoethyl)-p-toluenesulfonylamino group, a hexadecylsulfonylamino group, a trimethylammonio group, etc.), a substituted or unsubstituted sulfamoyl group (e.g., a dimethylsulfamoyl group, a hexadecylsulfamoyl group, a sulfamoyl group, a methyloctadecylsulfamoyl group, a methylhexadecylsulfamoyl group, a 2-cyanoethylhexadecylsulfamoyl group, a phenylsulfamoyl group, an N-(3,4-dimethylphenyl)-N-octylsulfamoyl group, a dibutylsulfamoyl group, a dioctadecylsulfamoyl group, a bis(2-methoxycarbonylethyl)sulfamoyl group, etc.), a substituted or unsubstituted acyloxy group (e.g., an acetoxy group, a benzoyloxy group, a decyloxy group, a chloroacetoxy group, etc.), a substituted or unsubstituted sulfonyloxy group (e.g., a methylsulfonyloxy group, a p-toluenesulfonyloxy group, a p-chlorophenylsulfonyloxy group, etc.), etc.

In general formula (B), n'' represents an integer of from 1 to 6; and $U_1$=—$Y_1$, $U_2$=—$Y_1$—$Y_2$, $U_3$=—$Y_1$—$Y_2$—$Y_3$, $U_4$=—$Y_1$—$Y_2$—$Y_3$—$Y_4$, $U_5$=—$Y_1$—$Y_2$—$Y_3$—$Y_4$—$Y_5$ and $U_6$=—$Y_1$—$Y_2$—$Y_3$—$Y_4$—$Y_5$—$Y_6$.

$Y_1$ to $Y_6$ each represents

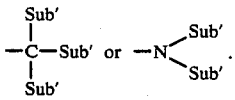

"Sub'" represents a mere bond ($\sigma$ bond, $\pi$ bond) or represents the substituent "Sub" of the above-mentioned formula (A). When "Sub'" is a mere bond, $Y_1$ to $Y_6$ each represent

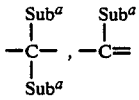

or —N= where $Sub^a$ is hydrogen or a substituent as mentioned above. In general formula (B), "Sub'"s are so selected that the total of the Hammett's substituent constants $\sigma_p$ of the substituents is +0.09 or more, preferably +0.3 or more, most preferably +0.45 or more.

Specific examples of EAG include an aryl group substituted by at least one electron attractive group (e.g., a 4-nitrophenyl group, a 2-nitro-4-N-methyl-N-octadecylsulfamoylphenyl group, a 2-N,N-dimethylsulfamoyl-4-nitrophenyl group, a 2-cyano-4-octadecylsulfonylphenyl group, a 2,4-dinitrophenyl group, a 2,4,6-tricyanophenyl group, a 2-nitro-4-N-methyl-N-octadecylcarbamoylphenyl group, a 2-nitro-5-octylthiophenyl group, a 2,4-dimethanesulfonylphenyl group, a 3,5-dinitrophenyl group, a 2-chloro-4-nitro-5-methylphenyl group, a 2-nitro-3,5-dimethyl-4-tetradecylsulfonylphenyl group, a 2,4-dinitronaphthyl group, a 2-ethylcarbamoyl-4-nitrophenyl group, a 2,4-bisdodecylsulfonyl-5-trifluoromethylphenyl group, a 2,3,4,5,6-pentafluorophenyl group, a 2-acetyl-4-nitrophenyl group, a 2,4-diacetylphenyl group, a 2-nitro-4-trifluoromethylphenyl group, etc.), a substituted or unsubstituted heterocyclic group (e.g., a 2-pyridyl group, a 2-pyrazyl group, a 5-nitro-2-pyridyl group, a 5-N-hexadecylcarbamoyl-2-pyridyl group, a 4-pyridyl group, a 3,5-dicyano-2-pyridyl group, a 5-dodecylsulfonyl-2-pyridyl group, a 5-cyano-2-pyrazyl group, a 4-nitrothiophen-2-yl group, a 5-nitro-1,2-dimethylimidazol-4-yl group, a 3,5-diacetyl-2-pyridyl group, a 1-dodecyl-5-carbamoylpyridinium-2-yl group, etc.), a substituted or unsubstituted quinone residue (e.g., a 1,4-benzoquinon-2-yl group, a 3,5,6-trimethyl-1,4-benzoquinon-2-yl group, a 3-methyl-1,4-naphthoquinon-2-yl group, a 3,6-dimethyl-5-hexadecylthio-1,4-benzoquinon-2-yl group, a 5-pentadecyl-1,2-benzoquinon-4-yl group, etc.), as well as vinylogs of the above-mentioned groups, and additionally a nitroalkyl group (e.g., a 2-nitro-2-propyl group, etc.), a nitroalkenyl group (e.g., a 2-nitroethenyl group, etc.), a monovalent residue of an $\alpha$-diketo compound (e.g., a 2-oxopropanoyl group, etc.), etc.

As mentioned above, $R^3$ is bonded to the nitrogen atom and the oxygen atom and represents an atomic group required for forming a 3-membered to 8-membered hetero ring. Examples of the hetero ring are mentioned below.

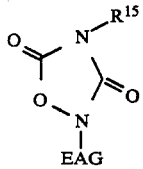

II-1

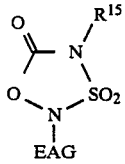

II-2

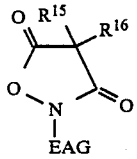

II-3

-continued

II-4

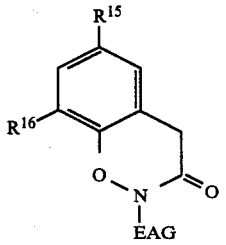

II-5

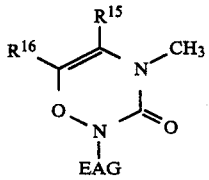

II-6

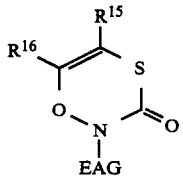

II-7

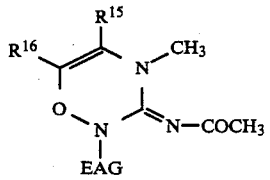

II-8

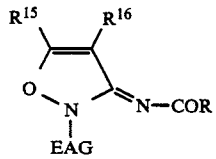

II-9

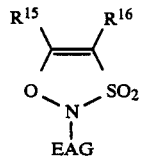

II-10

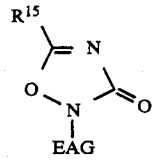

II-11

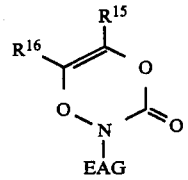

-continued

II-12

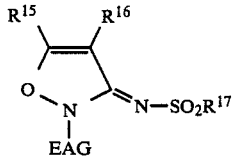

II-13

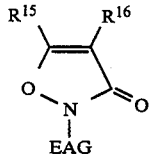

In the above formulae, $R^{15}$, $R^{16}$ and $R^{17}$ may be the same or different and each represents a hydrogen atom, an aliphatic group, an aromatic group, a heterocyclic group, an acyl group, an alkoxycarbonyl group, a carbamoyl group, a sulfonyl group, an aryloxycarbonyl group, a sulfamoyl group, a cyano group, a nitro group, a halogen atom, an amino group, an alkoxy group, an aryloxy group, a hydroxyl group, a ureido group, an aminocarbonyloxy group, an alkoxycarbonylamino group, an amido group, a sulfo group, a carboxyl group, a sulfonamido group, an acyloxy group, or an aryloxycarbonylamino group.

Among the compounds of general formula (II), especially preferred are compounds of the following general formula (III) which have more sufficient characteristics as an oxidizing compound.

(III)

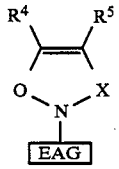

in which EAG has the same meaning as mentioned above; X represents a divalent linking group and is more preferably

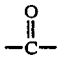

or —$SO_2$—; and $R^4$ and $R^5$ each represents a hydrogen atom or a substitutable group, or they may be linked together to form a saturated or unsaturated carbocyclic or heterocyclic ring.

Preferred examples of $R^4$ and $R^5$ include a hydrogen atom, a substituted or unsubstituted alkyl group (e.g., a methyl group, an ethyl group, a t-butyl group, an octadecyl group, a phenethyl group, a carboxymethyl group, etc.), a substituted or unsubstituted aryl group (e.g., a phenyl group, a 3-nitrophenyl group, a 4-methoxyphenyl group, a 4-acetylaminophenyl group, a 4-methanesulfonylphenyl group, a 2,4-dimethylphenyl group, a 4-tetradecyloxyphenyl group, etc.), a substituted or unsubstituted heterocyclic group (e.g., a 2-pyridyl group, a 2-furyl group, a 3-pyridyl group, etc.), an acyl group (e.g., an acetyl group, a benzoyl group, a dodecanoyl group, a 4-acetamidobenzoyl group, etc.), an alkoxycarbonyl group (e.g., a methoxycarbonyl group, a methoxyethoxycarbonyl group, a butoxycarbonyl group, etc.), a carbamoyl group (e.g., a carbamoyl group, an ethylcarbamoyl group, a phenylcarbamoyl group, a diethylcarbamoyl group, a dodecylcarbamoyl group, etc.), a sulfonyl group (e.g., a methanesulfonyl group, a p-toluenesulfonyl group, a hexadecylsulfonyl group, etc.), an aryloxycarbonyl group (e.g., a phenoxycarbonyl group, a naphthyloxycarbonyl group, etc.), a sulfamoyl group (e.g., a dimethylsulfamoyl group, a butylsulfamoyl group, a phenylsulfamoyl group, etc.), a cyano group, a nitro group, a halogen atom (e.g., F, Cl, Br, I, etc.), an amino group (e.g., an amino group, a methylamino group, a diethylamino group, a methylphenylamino group, a 1-pyrrolidino group, etc.), an alkoxy group (e.g., a methoxy group, an ethoxy group, an octyloxy group, an isopropyloxy group, etc.), an aryloxy group (e.g., a phenoxy group, a 4-chlorophenoxy group, a 3-pentadecylphenoxy group, etc.), a hydroxyl group, a ureido group (e.g., a 3-methylureido group, a 3,3-diethylureido group, a 1-methyl-3-phenylureido group, etc.), an aminocarbonyloxy group (e.g., a dibutylaminocarbonyloxy group, a phenylaminocarbonyloxy group, a cyclohexylaminocarbonyloxy group, etc.), an alkoxycarbonylamino group (e.g., a methoxycarbonylamino group, a hexyloxycarbonylamino group, etc.), an amido group (e.g., an acetamido group, a benzamido group, etc.), a sulfo group or a salt thereof, a carboxyl group or a salt thereof, a sulfonamido group (e.g., a methanesulfonamido group, a phenylsulfonamido group, a dodecylsulfonamido group, etc.), an acyloxy group (e.g., an acetoxy group, a benzoyloxy group, etc.), an aryloxycarbonylamino group (e.g., a phenoxycarbonylamino group, etc.), etc.

Examples of condensed rings formed by linking of $R^4$ and $R^5$ include the following groups, which are represented as the entire ring.

III-1

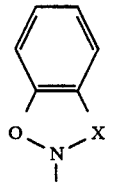

III-2

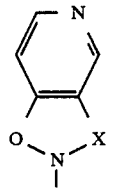

III-3

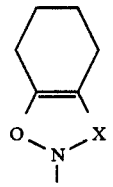

-continued

III-4

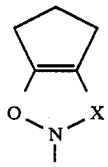

Specific examples of the compounds for use in the present invention are mentioned below so as to further concretely illustrate the present invention, but these are not intended to limit the scope of the present invention.

1.

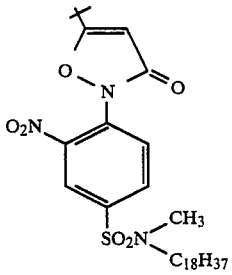

In these structural formulae,

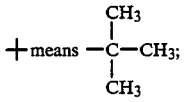

means $-CH_2-CH_2-CH_2-$; and

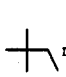

means $-C(CH_3)_2-CH_2-CH_3$.

Next, the preparation methods of the compounds for use in the present invention are described below.

All the compounds for use in the present invention have an N—O single bond. As a source of the N—O bond, there are considered three approaches: (1) using a hydroxylamine as the source, (2) reducing a nitro group to give a hydroxylamine, and (3) using a heterocyclic group containing an H—N—O— bond.

Regarding method (1), a halide and a hydroxylamine are reacted in a solvent such as DMF or DMSO, whereby the bond can be introduced in the compound with ease. Regarding method (2), the compounds can be synthesized in accordance with the method described in S. R. Sandler & W. Karo, *Organic Functional Group Preparations*. Regarding method (3), an HN—O bond-containing heterocyclic compound (examples of which are described in A. R. Katritzky & C. W. Rees, *Comprehensive Heterocyclic Chemistry*) is anionized at the nitrogen atom and then is reacted with a halide in a solvent such as DMF or DMSO, whereby the N—O— single bond is introduced into the compound.

Examples of the production of the compounds are described hereunder in detail. Unless otherwise described herein, all parts, percents, ratios and the like are by weight.

SYNTHESIS EXAMPLE 1

Synthesis of 5-t-Butyl-3-hydroxyisoxazole:

Synthesis Example 1-1

Synthesis of 3-t-Butyl-5-pyrazolidone 1.0 kg of ethyl pivaloylacetate was dissolved in 2.5 liters of ethanol and 320 g of hydrazine hydrate was dropwise added thereto with cooling with water. After the completion of the dropwise addition, the whole was reacted overnight at room temperature, and then 5.0 liters of water was added thereto and stirred. The crystal which precipitated was filtered under reduced pressure, washed well with water and then with a small amount of methanol, and then dried with air. Yield: 812 g, 98.5%.

Synthesis Example 1-2

Synthesis of 4,4-Dibromo-3-t-butyl-5-pyrazolidone 658 g of 3-t-butyl-5-pyrazolidone was dissolved in 2.0 liters of acetic acid. To this solution was dropwise added 1.5 kg of bromine with stirring and cooling with water. After the completion of the dropwise addition, the reaction was effected overnight. 5.0 liters of water was then added. The crystal precipitated was filtered under reduced pressure, washed well with water and then with a small amount of methanol, and then dried with air. Yield: 1.36 kg, 97.2%.

Synthesis Example 1-3

Synthesis of 4,4-Dimethyl-2-pentynoic acid 552 g of sodium hydroxide was dissolved in 3.0 liters of water and ice was added thereto to adjust the temperature to 5° C. or lower. Next, while stirring, dibromo-3-t-butyl-5-pyrazolidone was added thereto little by little while maintaining the temperature at 5° C. or lower. If the temperature would rise, ice was added, and acetonitrile was added in order to prevent foaming. After the completion of the reaction, 6 N hydrochloric acid was added to make the reaction solution acidic, and then the solution was subjected to extraction twice with ethyl acetate.

The extracted liquid was dried over anhydrous sodium sulfate, and then the ethyl acetate was distilled away under reduced pressure. The residual oil was 4,4-dimethyl-2-pentynoic acid. The oil just as extracted was used in the next reaction.

Synthesis Example 1-4

Synthesis of 4,4-Dimethyl-2-pentynoic Acid Chloride 466 g of 4,4-dimethyl-2-pentynoic acid was blended with 3.5 liters of methylene chloride and stirred. 483 g of thionyl chloride was added thereto and reacted for 1 hour and then heated under reflux, whereby a hydrogen chloride gas was vigorously generated. After the reaction system was heated under reflux for 2 hours, the solvent was distilled away under reduced pressure. The product was a colorless liquid having a boiling point of about 70° C. at 20 mm Hg. Yield: 290 g, 54.3%.

Synthesis Example 1-5

Synthesis of 5-t-butyl-3-hydroxyisoxazole 308 g of hydroxylamine hydrochloride was dissolved in 2.5 liters of water and 176 g of sodium bicarbonate was added thereto. Ice was added to the resulting solution and the temperature was kept at 5° C. or lower; 290 g of 4,4-dimethyl-2-pentynoic acid chloride was added dropwise thereto with vigorous stirring.

The product precipitated in the form of a colorless crystal. The crystal was filtered under reduced pressure and washed with water. Next, the thus obtained crystal was dissolved in 2.5 liters of 2 N sodium hydroxide solution and allowed to stand overnight at room temperature. The reaction solution was thereafter neutralized to give a colorless crystal of 5-t-butyl-3-hydroxyisoxazole. Yield: 190 g, 67.4%. m.p. 99°–101° C.

SYNTHESIS EXAMPLE 2

Synthesis of Compound No. 2:

Synthesis Example 2-1

Synthesis of
N-Methyl-N-octadecyl-3-nitro-4-chlorobenzamide 105.7 g of 3-nitro-4-chlorobenzoic acid and 800 ml of acetonitrile were mixed, and 68.6 g of thionyl chloride was added to the mixture and heated under reflux for 4 hours. After cooling, the solvent was distilled away and the residue was dissolved in chloroform. To the resulting solution was added 63.5 g of triethylamine, and the whole was adjusted to be 5° C. Next, a chloroform solution of 148.6 g of N-methyloctadecylamine was added dropwise thereto. After the completion of the reaction, water was added and the resulting mixture was subjected to liquid separation. The aqueous phase thus separated was dried over anhydrous sodium sulfate. After the inorganic substances were filtered off and the solvent was evaporated, the product was recrystallized from acetonitrile/methanol (1/3). Yield: 186 g, 76.0%. m.p. 55°–56° C.

Synthesis Example 2-2

Synthesis of
5-t-Butyl-2-(4-N-methyl-N-octadecylcarbamoyl-2-nitrophenyl)-3-isoxazolone To 300 ml of dimethylformamide was added 34.1 g of N-methyl-N-octadecyl-3-nitro-4-chlorobenzamide, 12.4 g of 5-t-butyl-3-hydroxyisoxazole and 12.4 g of potassium carbonate and the reaction was effected for 5 hours at 100° C. The solvent was distilled away under reduced pressure. Ethyl acetate and water were added to the residue and stirred. Thereafter, the resulting organic phase was taken out and the main product was isolated therefrom by silica gel column chromatography. This was recrystallized from n-hexane/ethyl acetate. Yield: 18.0 g, 43.1%. m.p. 64° C.

SYNTHESIS EXAMPLE 3

Synthesis of Compound No. 11:

Synthesis Example 3-1

Synthesis of
4-Chloromethyl-5-t-butyl-2-(4-N-methyl-N-octadecylcarbamoyl-2-nitrophenyl)-3-isoxazolone 36 g of 5-t-butyl-2-(4-N-methyl-N-octadecylcarbamoyl-2-nitrophenyl)-3-isoxazolone produced in Synthesis Example 2, 5.7 g of paraformaldehyde and 10.3 g of zinc chloride were blended with 250 ml of acetic acid and reacted, while hydrogen chloride gas was blown thereinto, for 20 hours at 100° C. After the completion of the reaction, the reaction mixture was cooled and poured into ice-water. The solid which precipitated was taken out by filtration and dissolved in chloroform and then purified by column chromatography. Yield: 10.0 g, 25.6%. m.p. 77° C.

Synthesis Example 3-2

Synthesis of
4-(4-t-Butoxycarbonylaminophenoxy)methyl-5-t-butyl-2-(4-N-methyl-N-octadecylcarbamoyl-2-nitrophenyl)-3-isoxazolone (Compound No. 11)

10.0 g of 4-chloromethyl-5-t-butyl-2-(4-N-methyl-N-octadecylcarbamoyl-2-nitrophenyl)-3-isoxazolone, 4.0 g of 4-t-butoxycarbonylaminophenol and 3.0 g of potassium carbonate were blended with 100 ml of acetone and then heated under reflux for 7 hours.

After the completion of the reaction, the acetone was distilled away, and ethyl acetate/water was added to the residue for extraction. The resulting organic phase was purified by silica gel column chromatography. Yield: 9.0 g, 70.5%. m.p. 95°-97° C.

SYNTHESIS EXAMPLE 4

Synthesis of Compound No. 10:

Synthesis Example 4-1

Synthesis of 5-Phenyl-3-hydroxyisoxazole

The compound was synthesized in accordance with the method described in *Chemical and Pharmaceutical Bulletin*, Vol. 14, No. 11, pages 1277 to 1286 (1966).

Synthesis Example 4-2

Synthesis of
5-Phenyl-2-(4-N-methyl-N-octadecylsulfamoyl-2-nitrophenyl)-3-isoxazolone 50.3 g of 2-nitro-4-N-methyl-N-octadecylsulfamoyl-1-chlorobenzene and 19.3 g of 5-phenyl-3-hydroxyisoxazole produced in Synthesis Example 4-1 were dissolved in dimethylformamide, and 16.8 g of potassium carbonate was added thereto and reacted for 5 hours at 80° C. Next, after the inorganic substances were filtered off, the solvent was distilled away under reduced pressure, and the product was crystallized from methanol. Yield: 52.2 g, 83.2%.

SYNTHESIS EXAMPLE 5

Synthesis of Compound No. 23:

Synthesis Example 5-1

Synthesis of
O-Methyl-N-(4-N-methyl-N-octadecylsulfamoyl-2-nitrophenyl)hydroxylamine 5.0 g of 2-nitro-4-N-methyl-N-octadecylsulfamoyl-1-chlorobenzene was dissolved in dimethylformamide, and 1.7 g of O-methylhydroxylamine hydrochloride and 2.8 g of potassium carbonate were added thereto and reacted for 4 hours at 80° C. After cooling, the reaction mixture was poured into water and the crystal which precipitated was taken out by filtration and then dried.

Synthesis Example 5-2

Synthesis of
O-Methyl-N-(4-N-methyl-N-octadecylsulfamoyl-2-nitrophenyl)-N-acetylhydroxylamine 2 g of the compound produced in Synthesis Example 5-1 was mixed with 20 ml of acetic anhydride, and a catalytic amount of a concentrated sulfuric acid was added to the mixture and reacted for 1 hour at 60° C. Once cooled, the reaction mixture was poured into water, and the crystal which precipitated was taken out and recrystallized from methanol. m.p. 55°-56° C.

SYNTHESIS EXAMPLE 6

Synthesis of Compound No. 31:

Synthesis Example 6-1

Synthesis of 4-Methyl-1,2,4-oxadiazole-3,5-dione Sodium Salt 140 g of hydroxylamine hydrochloride was dissolved in water, and 80 g of sodium hydroxide was added thereto and cooled to 0° C. Next, 137 g of isobutyl chlorocarbonate was added dropwise thereto. After the completion of the reaction, the reaction mixture was subjected to extraction with ethyl acetate and dried with anhydrous sodium sulfate, and then the solvent was distilled away to give an oil.

13.3 g of the oil was blended with ether, and 5.7 g of methyl isocyanate was added dropwise thereto with cooling with ice, and then the whole was reacted for 8 hours at room temperature. Next, the ether was distilled away and methanol was added to the resulting oily product, then 19.3 g of a 28% sodium methylate was added thereto and reacted for 4 hours at room temperature to give a crystal. m.p. 280° C. or higher.

Synthesis Example 6-2

Synthesis of
2-(2,4-Dinitrophenyl)-1,2,4-oxadiazole-3,5-dione 2.8 g of the compound produced in Synthesis Example 6-1 and 4 g of 2,4-dinitrochlorobenzene were dissolved in DMSO and reacted for 6 hours at room temperature. Thereafter, the reaction mixture was poured into water to give a crystal, which was then purified by column chromatography. Yield: 32%. m.p. 136°-138° C.

Other compounds of formula (I) of the present invention can also be produced easily in accordance with the above-mentioned description for the synthesis methods and the above-mentioned Synthesis Examples.

The compounds of the present invention may be added to a silver halide emulsion layer or a hydrophilic colloid layer to be provided above or below the emulsion layer or to the both layers, whereby the intended object can be attained. When the compounds of the present invention are added to the layers in accordance with the above-mentioned various objects, the amount of the compound to be added varies according to the object. In general, the amount is preferably from $1\times10^{-7}$ mol to $1\times10^{3}$ mol per mol of silver halide. When the compounds of the present invention are used as an antifoggant, stabilizer or desensitizer, the amount of the compound to be added is preferably from $1\times10^{-7}$ mol to $1\times10^{1}$ mol, more preferably from $1\times10^{-5}$ mol to $1\times10^{-1}$ mol, and most preferably from $1\times10^{-4}$ mol to $1\times10^{-2}$ mol, per mol of silver halide.

For the addition of the compound of the present invention to silver halide emulsion layer and/or other hydrophilic colloid layer, conventional methods can be employed. Specifically, when the compound is soluble in water, it can be added to an aqueous gelatin solution directly or in the form of a solution as dissolved in water. When the compound is insoluble or hardly soluble in water, it is dissolved in a water-miscible solvent and then blended with an aqueous gelatin solution, or alternatively, the method described, for example, in U.S. Pat. No. 2,322,027 can also be used. For example, the water-insoluble or hardly water-soluble compound is first dissolved in an alkyl phthalate (e.g., dibutyl phthalate, dioctyl phthalate, etc.), a phosphate (e.g., diphenyl phosphate, triphenyl phosphate, tricresyl phosphate, dioctylbutyl phosphate, etc.), a citrate (e.g., tributyl acetylcitrate, etc.), a benzoate (e.g., octyl benzoate, etc.), an alkylamide (e.g., diethyllaurylamide, etc.), a fatty acid ester (e.g., dibutoxyethyl succinate, diethyl azelate, etc.), a trimesate (e.g., tributyl trimesate, etc.), etc., or in an organic solvent having a boiling point of from 30° C. to 150° C., for example, a lower alkyl acetate such as ethyl acetate and butyl acetate, or ethyl propionate, secondary butyl alcohol, methyl isobutyl ketone, β-ethoxyethyl acetate, methyl Cellosolve acetate, etc., and then the resulting solution is dispersed in a hydrophilic colloid. The above-mentioned high boiling point organic solvents and low boiling point organic solvents can be used in mixture.

Specific embodiments of using the compounds of the present invention are described hereunder in more detail.

(1) The compounds of formula (I) of the present invention are effective for overcoming the black spots of photographic light-sensitive materials which have a monodispersed silver halide emulsion layer and which may form an ultrahard contrast negative image with a stable developer by the action of a hydrazine derivative as described in U.S. Pat. Nos. 4,224,401, 4,168,977, 4,241,164, 4,311,781, 4,272,606, 4,221,857, 4,243,739, 4,272,614, 4,269,929, etc. The above-mentioned stable developer means a developer which contains at least 0.15 mol/liter of sulfite ions as a preservative and which has a pH value of from 10.0 to 12.3. As the developer contains a large amount of a preservative, this is more stable than conventional lith developers (which contain only an extremely small amount of sulfite ions), and in addition, since this developer has a relatively low pH value, is hardly oxidized with air and is more stable than the developer (pH=12.8) for the hard contrast image formation system described, for example, in U.S. Pat. No. 2,419,957, etc. In such a case, the compound of formula (I) of the present invention is used in an amount of from $1\times10^{-5}$ mol to $8\times10^{-1}$ mol per mol of silver halide.

In the practice of the present invention, when a hydrazine derivative is incorporated into the photographic light-sensitive material, it is preferred that the derivative is added to the silver halide emulsion layer, but the derivative may also be added to any other non-light-sensitive hydrophilic colloid layer (for example, protective layer, interlayer, filter layer, antihalation layer, etc.). Specifically, when the compound is soluble in water, the derivative may be added to the hydrophilic colloid solution in the form of an aqueous solution, or when the compound is hardly soluble in water, this may be added thereto in the form of a solution in a water-miscible organic solvent such as alcohols, esters, and ketones. When the compound is added to the silver halide emulsion layer, the addition may be carried out in any stage at the beginning of the chemical ripening and before the coating, but the addition is preferably carried out in a stage after the completion of the chemical ripening and before the coating. In particular, it is most preferred that the compound is added to the coating composition just as prepared for coating.

The amount of the hydrazine derivative to be added is desirably to be an optimal one in accordance with the grain size of the silver halide emulsion grains, the halogen composition, the means and degree of the chemical sensitization, the relation between the layer to which the derivative is added and the silver halide emulsion layer, the kind of the antifoggant compound used, etc. The test method for determining the optimal amount of the hydrazine derivative to be added is well known by anyone skilled in the art. In general, the hydrazine derivative is used preferably in an amount of from $10^{-6}$ mol to $1\times10^{-1}$ mol, especially from $10^{-5}$ mol to $4\times10^{-2}$ mol, per mol of silver halide.

(2) The compounds of formula (I) of the present invention can be applied to a multilayer multicolor photographic light-sensitive material having at least two light-sensitive layers each having a different spectral sensitivity on a support, mainly for the purpose of antifoggant. A multilayer color photographic light-sensitive material generally has at least one red-sensitive emulsion layer, at least one green-sensitive emulsion layer and at least one blue-sensitive emulsion layer. The order of these layers on the support is not critical but may freely be determined in accordance with the use of the material. One preferred order of the layers comprises a red-sensitive layer, a green-sensitive layer and a blue-sensitive layer in this order from the side of the support, or a blue-sensitive layer, a red-sensitive layer and a green-sensitive layer in this order from the side of the support. The respective emulsion layers as mentioned above may comprise two or more emulsion layers each having a different sensitivity degree, or a non-light-sensitive layer may exist between two or more emulsion layers having the same color sensitivity. A cyan-forming coupler is generally incorporated into the red-sensitive emulsion layer, a magenta-forming coupler into the green-sensitive emulsion layer and a yellow-forming coupler into the blue-sensitive emulsion layer, but any other combinations can also be employed, as the case may be.

The couplers which may be used are not specifically limitative, but, for example, 5-pyrazolone couplers, pyrazolobenzimidazole couplers, cyanoacetylcumarone couplers, open chain acylacetonitrile couplers, etc., can be used as a magenta coupler; acylacetamido couplers (e.g., benzoylacetanilides, pivaloylacetanilides, etc.), etc., can be used as a yellow coupler; and naphthol couplers, phenol couplers, etc., can be used as a cyan coupler. It is desirable that these couplers are either (1) nondiffusible (having a hydrophobic group which is designated as a ballast group in the molecule) or (2) are polymerized. The couplers may be either 4-equivalent or 2-equivalent to silver ion. In addition, the couplers may be (1) colored couplers having a color correcting effect or (2) so-called DIR couplers which can release a development inhibitor with development, or (3) DAR couplers which can release a development accelerator with development.

In addition to DIR couplers, colorless DIR coupling compounds which form a colorless product by coupling reaction and release a development inhibitor can also be incorporated into the photographic light-sensitive material of the present invention.

Further, in addition to DIR couplers, other compounds which may release a development inhibitor with development can be incorporated into the material of the present invention.

Two or more kinds of the above-mentioned couplers and other compounds can be incorporated together into the same layer so as to meet the necessary characteristic for the photographic light-sensitive material, or the same compound can be added to two or more different layers without problems.

The compounds of the present invention can be used together with the couplers to be incorporated together into the same layer, or alternatively, these can also be added to a photographic auxiliary layer such as an interlayer, etc., in the form of an independent emulsified dispersion.

When the compound of the present invention is added to color photographic light-sensitive materials, it is preferably added to the respective layers in an amount of from 0.1 to 50 mol %, preferably from 0.3 to 15 mol %, with respect to the respective couplers of the respective layers, that is, to the yellow coupler in the blue-sensitive emulsion layer, to the magenta coupler in the green-sensitive emulsion layer, or to the cyan coupler of the red-sensitive emulsion layer. The amount of the compound of the present invention to be added is preferably from $1\times10^{-5}$ mol to $8\times10^{-2}$ mol, especially from $1\times10^{-4}$ mol to $5\times10^{-2}$ mol, per mol of the silver halide of the layer to which the compound is added.

(3) The compounds of formula (I) of the present invention are effective for preventing fogs in black-and-white photographic light-sensitive materials, especially X-ray photographic light-sensitive materials, which have a silver iodobromide or silver chloroiodobromide emulsion layer containing silver chloride in an amount of up to 50 mol % and silver iodide in an amount of up to 15 mol % on one side or both sides of the support. In this case, the amount of the compound to be added is preferably from $1\times10^{-6}$ mol to $1\times10^{-1}$ mol, especially from $1\times10^{-5}$ mol to $5\times10^{-2}$ mol, per mol of the silver halide in the material.

The silver halide for use in the materials of the present invention may be any one of silver chloride, silver bromide, silver iodide, silver chlorobromide, silver chloroiodide, silver iodobromide and silver chloroiodobromide. The halogen composition in the grains may be uniform or the grains may have a multilayer structure having different compositions in the surface part and inner part (Japanese Patent Application (OPI) Nos. 154232/82, 108533/83, 48755/84 and 52237/84, U.S. Pat. No. 4,433,048 and European Patent Pat. No. 100,984). In addition, tabular grains having a grain thickness of 0.5 μm or less, a diameter of at least 0.6 μm and a mean aspect ratio of 5 or more (U.S. Pat. Nos. 4,414,310 and 4,435,499, West German Patent Application (OLS) No. 3,241,646A1, etc.), as well as monodispersed emulsions having a nearly uniform grain size distribution (Japanese Patent Application (OPI) Nos. 178235/82, 100846/83 and 14829/83, International Patent Application No. 83/02338A1, European Patent Nos. 64,412A3 and 83,377A1, etc.) can also be used in the present invention. Two or more different kinds of silver halides which are different in the crystal habit, halogen composition, grain size, grain size distribution, etc., can be used together. Also, two or more different monodispersed emulsions each having a different mean grain size can be blended and used so as to control the gradation of the photographic material.

In the photographic emulsions for use in the present invention, the mean grain size of the silver halide grains is preferably from 0.001 μm to 10 μm, more preferably from 0.001 μm to 5 μm. The silver halide emulsions may be prepared by an acid method, a neutralization method, an ammonia method, etc. Also, as a method of reacting a soluble silver salt and soluble halide(s), a single jet method, a double jet method, or a combination thereof may be used. A reverse mixing method of forming silver halide grains in the existence of excessive silver ions, or a controlled double jet method of keeping a constant pAg in a liquid phase of forming silver halide grains can also be employed. In order to accelerate the growth of grain, the concentration of the silver salt and halide(s) to be added as well as the amount of the salts and the addition speed thereof can also be elevated (Japanese Patent Application (OPI) Nos. 142329/80 and 158124/80, U.S. Pat. No. 3,650,775, etc.).

Epitaxial junction structure type silver halide grains can also be used (Japanese Patent Application (OPI) No. 16124/81, U.S. Pat. No. 4,094,684).

In the formation of the silver halide grains for use in the present invention, ammonia, the organic thioether derivatives described in Japanese Patent Publication No. 11386/72 or the sulfur-containing compounds described in Japanese Patent Application (OPI) No. 144319/78 can be used as a silver halide solvent.

In the grain formation or physical ripening, a cadmium salt, a zinc salt, a lead salt, a thallium salt, etc., can be added to the grain forming reaction system or to the resulting grains.

Further, a water-soluble iridium salt such as iridium (III, IV) chloride, ammonium hexachloroiridate, etc., or a water-soluble rhodium salt such as rhodium chloride, etc., can also be used for the purpose of overcoming high intensity reciprocity law failure or low intensity reciprocity law failure.

Soluble salts can be removed from the silver halide emulsions after the formation of the precipitate or after the physical ripening, and the removal can be carried out by noodle washing or flocculation.

The silver halide emulsions can be used without after-ripening, but, in general, they are used after being chemically sensitized. For the emulsions for general type photographic light-sensitive materials, known sulfur sensitization, reduction sensitization, noble metal sensitization, etc., can be employed singly or in combination. The chemical sensitization can also be carried out in the presence of nitrogen-containing heterocyclic compounds (Japanese Patent Application (OPI) Nos. 126526/83 and 215644/83).

The silver halide emulsions for use in the present invention may be surface latent image type emulsions which form latent images mainly on the surfaces of the grains, or may be internal latent image type emulsions which form latent images mainly in the inside of the grains. A direct reversal emulsion comprising a combination of an internal latent image type emulsion and a nucleating agent can also be used in the present invention. The internal latent image type emulsions suitable for the purpose are described, for example, in U.S. Pat. Nos. 2,592,250 and 3,761,276, Japanese Patent Publication No. 3534/83, Japanese Patent Application (OPI) No. 136641/82, etc. Nucleating agents which are preferably used in the present invention in the form of the above-mentioned combination are described in U.S. Pat. Nos. 3,227,552, 4,245,037, 4,255,511, 4,266,031 and 4,276,364, and West German Patent Application (OLS) No. 2,635,316.

The silver halides for use in the present invention can be spectrally sensitized with methine dyes, etc. Dyes which can be used for the purpose include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes.

These sensitizing dyes can be used singly or in combination, and the combination of the sensitizing dyes is often used especially for supersensitization.

The silver halide emulsions for use in the present invention may further contain, together with the sensitizing dye(s), dyes having no spectral sensitizing action by themselves or materials which do not substantially absorb visible light but show supersensitizing action. For example, the emulsions may contain a nitrogen-containing heterocyclic group-substituted aminostyryl compound (for example, those described in U.S. Pat. Nos. 2,933,390, 3,635,721, etc.), an aromatic organic acid/formaldehyde condensation product (for example, those described in U.S. Pat. No. 3,743,510, etc.), a cadmium salt, an azaindene compound, etc. The combinations described in U.S. Pat. Nos. 3,615,613, 3,615,641, 3,617,295 and 3,635,721 are especially useful.

As the binder or protective colloid which can be used for the silver halide emulsion layers, interlayers, etc., of the photographic light-sensitive materials of the present invention, gelatin is advantageously used, but other hydrophilic colloids can also be used singly or together with gelatin.

The gelatin for use in the present invention may be a lime-processed gelatin or an acid-processed gelatin. The details for the preparation of gelatins are mentioned in Arthur Veis, *The Macromolecular Chemistry of Gelatin* (published by Academic Press, 1964).

Surfactants can be added to the photographic emulsions for use in the present invention singly or in combination.

Surfactants are generally used as a coating aid, but they may often be used for other purposes, for example, for emulsification and dispersion, elevation of sensitivity, improvement of photographic characteristic, static charge prevention, antiblocking, etc. The surfactants include natural surfactants such as saponin, etc.; nonionic surfactants such as alkylene oxide series surfactants, glycerin series surfactants, glycidol series surfactants, etc.; cationic surfactants such as higher alkylamines, quaternary ammonium salts, pyridines and other heterocyclic compounds, phosphonium compounds, sulfonium compounds, etc.; anionic surfactants containing an acid group such as carboxylic acid , sulfonic acid, phosphoric acid , sulfate or phosphate groups; and ampholytic surfactants such as amino acid , aminosulfonic acid , aminoalcohol sulfates or phosphates, etc.

The photographic emulsions for use in the present invention can contain various compounds together with the compounds of the present invention for the purpose of preventing fog during the manufacture step, storage or photographic processing step of the photographic materials or for the purpose of stabilizing the photographic characteristics of the materials. For example, various kinds of compounds known as an anti-foggant or a stabilizer can be used for these purposes, which include, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), etc.; mercaptopyrimidines; mercaptotriazines; thioketo compounds such as oxazolinethione; azaindenes such as triazaindenes, tetraazaindenes (especially, 4-hydroxy-substituted (1,3,3a,7-tetraazaindenes), pentaazaindenes, etc.; benzenethiosulfonic acids, benzenesulfinic acids, benzenesulfonic acid amides, etc.

The photographic light-sensitive materials of the present invention can contain, in the photographic emulsion layers, thioether compounds, thiomorpholines, quaternary ammonium salt compounds, urethane derivatives, urea derivatives, imidazole derivatives, 3-pyrazolidones, etc., for the purpose of elevating the sensitivity, intensifying the contrast or accelerating the developability.

The photographic light-sensitive materials of the present invention can also contain, in the photographic emulsion layers or in any other hydrophilic colloid layers, a dispersion of a water-insoluble or hardly water-soluble synthetic polymer for the purpose of improving the dimensional stability. For example, polymers made of monomers of an alkyl (meth)acrylate, an alkoxyalkyl (meth)acrylate, a glycidyl (meth)acrylate, a (meth)acrylamide, a vinyl ester (e.g., vinyl acetate), an acrylonitrile, an olefin or a styrene or a mixture thereof or polymers made of these monomers in combination with other comonomers of an acrylic acid, a methacrylic acid, an $\alpha,\beta$-unsaturated dicarboxylic acid, a hydroxyalkyl (meth)acrylate, a sulfoalkyl (meth)acrylate, a styrenesulfonic acid, etc., can be used for the purpose.

As the binder for use in the emulsion layers and auxiliary layers (e.g., protective layer, interlayer) of the photographic light-sensitive materials of the present invention, hydrophilic colloids are preferred, and especially, gelatin is most preferably used, but other hydrophilic colloids besides gelatin can also be used. For example, there are proteins such as gelatin derivatives, graft polymers of gelatin and other polymers, albumin, casein, etc.; cellulose derivatives such as hydroxyethyl cellulose, carboxymethyl cellulose, cellulose sulfate, etc.; saccharose derivatives such as sodium alginate, starch derivatives, etc.; and various synthetic hydrophilic homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc. In addition, a lime-processed gelatin, an acid-processed gelatin or an enzyme-processed gelatin can also be used.

The photographic light-sensitive materials of the present invention can further contain inorganic or organic hardeners in the photographic emulsion layers or in other hydrophilic colloid layers. For example, these can contain a chromium salt (e.g., chromium alum, chromium acetate, etc.), an aldehyde compound (e.g., formaldehyde, glyoxal, glutaraldehyde, etc.), an N-methylol compound (e.g., dimethylolurea, methyloldimethylhydantoin, etc.), a dioxane derivative (e.g., 2,3-dihydroxydioxane, etc.), an active vinyl compound (e.g., 1,3,5-triacryloylhexahydro-s-triazine, 1,3-vinylsulfonyl-2-propanol, etc.), an active halogen compound (e.g., 2,4-dichloro-6-hydroxy-s-triazine, etc.), a mucohalogenic acid (e.g., mucochloric acid, mucophenoxychloric acid, etc.), etc., singly or in combination.

When the photographic light-sensitive materials of the present invention are those for graphic arts, a hydrazine derivative can be incorporated into the material to intensify the hard contrast of the material. Preferred examples of hydrazine derivatives which can be used in the present invention are the arylhydrazides described in U.S. Pat. No. 4,478,928, which contain a sulfinic acid residue bonded to the hydrazo moiety, as well as compounds of general formula (IV):

$$R_1—NHNH—G—R_2 \quad (IV)$$

in which $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group or a substituted or unsubstituted aryloxy group; and G represents a carbonyl group, a sulfonyl group, a sulfoxy group, a phosphoryl group or an N-substituted or unsubstituted iminomethylene group.

As hydrazine derivatives which can be used in the present invention may further be mentioned, in addition to the above-mentioned compounds, those described in *Research Disclosure*, Item 23516 (November, 1983), page 346 and publications referred therein, as well as in U.S. Pat. Nos. 4,080,207, 4,269,929, 4,276,364, 4,278,748, 4,385,108, 4,459,347, 4,560,638 and 4,478,928, British Patent No. 2,011,391B and Japanese Patent Application (OPI) No. 179734/85.

The compound of formula (IV) is preferably used in an amount of from $1\times10^{-6}$ mol to $5\times10^{-2}$ mol, especially preferably from $1\times10^{-5}$ mol to $2\times10^{-2}$ mol, per mol of the silver halide in the photographic material.

The photographic light-sensitive materials of the present invention can contain various kinds of additives as mentioned above, and in addition to these additives, further additives may also be added to the materials in accordance with the object and the use of the materials.

These additives are described in more detail in *Research Disclosure*, Item 17643 (December, 1978) and Item 18716 (November, 1979), and the relevant parts are summarized in the following Table.

| No. | Additives | RD 17643 | RD 18716 |
|---|---|---|---|
| 1. | Chemical Sensitizer | p. 23 | p. 648, right column |
| 2. | Sensitivity Enhancer | | " |
| 3. | Spectral Sensitizer, Supersensitizer | pp. 23–24 | from p. 648, right column to p. 649, right column |
| 4. | Brightening Agent | p. 24 | |
| 5. | Antifoggant, Stabilizer | pp. 24–25 | p. 649, right column |
| 6. | Light Absorber, Filter Dye, UV Absorber | pp. 25–26 | from p. 649, right column to p. 650, left column |
| 7. | Stain Inhibitor | p. 25, right column | p. 650, from left to right column |
| 8. | Color Image Stabilizer | p. 25 | |
| 9. | Hardener | p. 26 | p. 651, left column |
| 10. | Binder | p. 26 | " |
| 11. | Plasticizer, Lubricant | p. 27 | p. 650, right column |
| 12. | Coating Aid, Surfactant | pp. 26–27 | " |
| 13. | Antistatic Agent | p. 27 | " |

The compounds of formula (I) of the present invention can be applied to black-and-white silver halide photographic materials (for example, X-ray light-sensitive materials, lith type or the like photographic light-sensitive materials for graphic arts, black-and-white negative films for picture taking, etc.) and color photographic light-sensitive materials (for example, color negative films, color reversal films, color papers, etc.). In addition, they can also be applied to diffusion transfer photographic light-sensitive materials (for example, color diffusion transfer elements, silver salt diffusion transfer elements, etc.), heat development photographic light-sensitive materials (for black-and-white photography or color photography), etc.

For the photographic materials for graphic arts, the image formation method described in Japanese Patent Application (OPI) Nos. 29837/86, 223738/86, 235947/87 and 238049/86 and Japanese Patent Application No. 77274/86 can be employed.

When the silver halide photographic materials of the present invention are processed by a conventional wet photographic process, any known method can be utilized. As the processing solutions, any known solutions can be used. The processing temperature is selected from the range between 18° C. and 50° C., but the temperature may be lower than 18° C. or may be higher than 50° C. In accordance with the object and the use of the materials to be processed, either of the development process of forming silver images (black-and-white photographic process) or the color development process of forming color images (color photographic process) can selectively be employed.

The photographic processes are described in detail in James, *The Theory of the Photographic Process*, 4th Ed., pages 291 to 436 and *Research Disclosure*, (RD 17643) (December, 1978), pages 28 to 30.

As the fixing solution for the black-and-white developer, any conventional one can be used. As the fixing agent, thiosulfates and thiocyanates, as well as organic sulfur compounds which are known to have an effect as a fixing agent, can be used. The fixing solution can contain a water-soluble aluminum salt as a hardener.

After color development, the photographic emulsion layers are generally bleached. The bleaching can be carried out simultaneously with fixation or separately therefrom. As the bleaching agent, the following compounds can be used: compounds containing polyvalent metals, such as iron(III), cobalt(III), chromium(VI), copper(II), etc., and peracids, quinones, nitroso compounds, etc. Specific examples of the bleaching agents include ferricyanides; bichromates; organic complexes of iron(III) or cobalt(III), for example, complexes with aminopolycarboxylic acids, such as ethylenediaminetetraacetic acid, nitrilotriacetic acid, 1,3-diamino-2-propanoltetraacetic acid, etc., or with organic acids such as citric acid, tartaric acid, malic acid, etc.; persulfates; permanganates; nitrosophenol, etc. Among them, potassium ferricyanide, sodium (ethylenediaminetetraacetato) iron(III) and ammonium (ethylenediaminetetraacetato) iron(III) are especially advantageous. (Ethylenediaminetetraacetato) iron(III) complexes can be used both in an independent bleaching solution and in a combined bleach-fixing solution.

The bleaching or bleach-fixing solution can contain various additives, for example, the bleaching accelerators described in U.S. Pat. Nos. 3,042,520 and 3,241,966, Japanese Patent Publication Nos. 8506/70 and 8836/70, etc., the thiol compounds described in Japanese Patent Application (OPI) No. 65732/78, etc.

The following examples are intended to illustrate the present invention in more detail but not to limit it in any way.

EXAMPLE 1

Preparation of Emulsion

An aqueous silver nitrate solution and an aqueous halide solution were simultaneously added to an aqueous gelatin solution kept at 50° C. by double jet method while maintaining the pAg of the reaction system at 7.8 and the whole was blended to give a monodispersed silver chlorobromide emulsion. The resulting emulsion was subjected to conventional sedimentation and washing with water to remove the soluble salts, and then sodium thiosulfate was added thereto for effecting chemical sensitization. The silver chlorobromide grains of the thus prepared emulsion were cubic and had a mean grain size of 0.30 μm and a silver bromide content of 30 mol %.

| Developer Composition: | |
|---|---|
| Hydroquinone | 40.0 g |
| 4,4-Dimethyl-1-phenyl-3-pyrazolidone | 0.4 g |
| Anhydrous Sodium Sulfite | 75 g |
| Sodium Hydrogencarbonate | 7.0 g |
| Disodium Ethylenediaminetetra-acetate | 1.0 g |
| Potassium Bromide | 6.0 g |
| 5-Methylbenzotriazole | 0.6 g |
| Water to make | 1 liter |
| Potassium Hydroxide to adjust | pH of 12.0 |

Sensitizing Dye (a) and Compound (b) shown below were added to the emulsion and then the compound of formula (I) of the present invention was also added thereto. The resulting emulsion was coated on a polyethylene terephthalate film support so that the silver amount coated was 3.50 g/m² and the gelatin amount coated was 2.00 g/m², whereupon an aqueous gelatin solution containing coating aids such as a surfactant, a thickening agent, etc., was also coated over the emulsion layer simultaneously with the coating of the emulsion layer so that the gelatin amount coated was 1.10 g/m². Thus, Sample Nos. 101 to 107 were prepared.

Each of the thus prepared film samples was exposed through a sensitometric exposure wedge by the use of Gray Scanner Nega Contact Screen No. 2, 150 L (by Dainippon Screen Co.), and the developed with a developer having the above-mentioned developer composition at 38° C. for 40 seconds, and fixed, rinsed in water and dried.

The results obtained are shown in Table 1 below.

Sensitizing Dye (a):

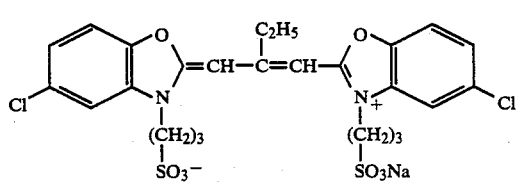

-continued

Compound (b):

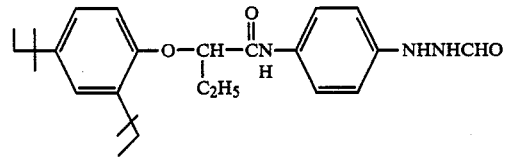

TABLE 1

| Sample No. | Compound No. of the Invention | Amount Added (mol/mol-Ag) | Amount of Compound (b) Added (mol/mol-Ag) | Relative Sensitivity Based on Control as 100 | Black Spot Level | Note |
|---|---|---|---|---|---|---|
| 1 | | — | $4 \times 10^{-3}$ | 100 | 3 | Control |
| 2 | 11 | $1 \times 10^{-3}$ | " | 98 | 3.5 | |
| 3 | 11 | $5 \times 10^{-3}$ | " | 95 | 4.0 | |
| 4 | 23 | $1 \times 10^{-3}$ | " | 100 | 3.5 | |
| 5 | 23 | $5 \times 10^{-3}$ | " | 98 | 4.0 | |
| 6 | 31 | $1 \times 10^{-3}$ | " | 90 | 4.5 | |
| 7 | 31 | $5 \times 10^{-3}$ | " | 75 | 5 | |

The black spot level means a visual 5-stage evaluation in which "5" is best and "1" is worst. Only degrees between "4" and "5", inclusive, are practicable for graphic arts. The degree of "4.5" means the medium between "4" and "5".

The results of Table 1 indicate that the incorporation of the compound of the formula (I) of the present invention into the photographic material is effective for improving the black spot level, or that is, the samples containing the compound of the present invention are superior to the control sample not containing the same with respect to the black spot level.

EXAMPLE 2

Preparation of Silver Halide Emulsion

Silver nitrate and an aqueous alkali halide solution were added to a gelatin solution to prepare an emulsion containing silver iodobromide grains (mean grain size 1.0 μm, AgI content 2 mol %) by the conventional ammonia method. The emulsion was desalted by conventional flocculation sedimentation, and then the resulting emulsion was subjected to gold-sulfur sensitization with chloroauric acid and sodium thiosulfate. Next, a stabilizer of 4-hydroxy-6-methyl-1,3,3a,7-tetraazaindene was added thereto. Thus, a light-sensitive silver iodobromide emulsion was prepared.

The compound of the present invention shown in Table 2 below was added to the thus prepared emulsion, and the resulting emulsion was coated on a support and dried. Thus, Sample Nos. 8 to 16 were obtained. Each of these samples was wedgewise exposed through an optical wedge with a sensitometer. The thus exposed samples were developed in an automatic developing machine RU (by Fuji Photo Film Co., Ltd.) at a development temperature of 37° C. for 90 seconds, using Developer (A) and Fixing Solution (A) mentioned below. After thus processed, the photographic characteristics of each sample were measured and the results are shown in Table 2.

| Developer (A): | |
|---|---|
| Ethylenediaminetetraacetic Acid | 1.2 g |
| Anhydrous Sodium Sulfite | 50.0 g |

-continued

| | |
|---|---|
| Potassium Hydroxide | 20.0 g |
| Hydroquinone | 25.0 g |
| 1-Phenyl-3-pyrazolidone | 1.5 g |
| Boric Acid | 10.0 g |
| Triethylene Glycol | 25.0 g |
| Glutaraldehyde | 5.0 g |
| Potassium Bromide | 6.0 g |
| Glacial Acetic Acid | 3.0 g |
| Anhydrous Sodium Bisulfite | 4.5 g |
| 5-Nitroindazole | 0.15 g |
| 5-Methylbenzotriazole | 0.03 g |
| Water to make | 1.0 liter |
| The pH value was adjusted to about 10.30 at 25° C. | |
| Fixing Solution (A): | |
| Ammonium Thiosulfate | 200.0 g |
| Anhydrous Sodium Sulfite | 20.0 g |
| Boric Acid | 8.0 g |
| Ethylenediaminetetraacetic Acid | 0.1 g |
| Aluminum Sulfate | 15.0 g |
| Sulfuric Acid | 2.0 g |
| Glacial Acetic Acid | 22.0 g |
| Water to make | 1.0 liter |
| The pH value was adjusted to about 4.10 at 25° C. | |

TABLE 2

| Sample No. | Compound Added | Amount Added (mol/mol-Ag) | Fog | Relative Sensitivity |
|---|---|---|---|---|
| 8 (control) | — | — | 0.19 | 100 |
| 9 | Nitron (Comparative Compound) | $3.5 \times 10^{-4}$ | 0.17 | 91 |
| 10 | Nitron (Comparative Compound) | $7.0 \times 10^{-4}$ | 0.15 | 80 |
| 11 | 12 | $7.0 \times 10^{-4}$ | 0.17 | 98 |
| 12 | 12 | $2.8 \times 10^{-3}$ | 0.14 | 88 |
| 13 | 18 | $7.0 \times 10^{-4}$ | 0.16 | 93 |
| 14 | 18 | $2.8 \times 10^{-3}$ | 0.14 | 85 |
| 15 | 35 | $7.0 \times 10^{-4}$ | 0.18 | 100 |
| 16 | 35 | $2.8 \times 10^{-3}$ | 0.16 | 95 |

In Table 2, the "relative sensitivity" means a reciprocal of the exposure required for obtaining the density of "fog value +1.0", which was represented by a relative value based on the index sensitivity (100) of Sample 1 developed at 35° C.

The results of Table 2 apparently indicate that Sample Nos. 11 to 16 containing the compound of the present invention were less fogged than Sample Nos. 9 and 10 containing the comparative compound in the range where the decrease of the sensitivity was small.

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing a compound of the general formula (I) which does not release a photographically useful group:

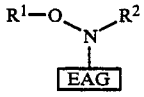

(I)

wherein EAG represents an electron accepting group which can accept an electron from a reducing substance, selected from an aryl group substituted by at least one electron attractive group, a substituted or unsubstituted heterocyclic group, a substituted or unsubstituted quinone residue, vinylogs of said groups and said residues, a nitroalkyl group, a nitroalkenyl group or a monovalent residue of an α-diketo compound; N and O represent a nitrogen atom and an oxygen atom, representively; $R^1$ and $R^2$ each represents a substituent except a hydrogen atom; and $R^1$ and $R^2$, $R^1$ and EAG, and $R^2$ and EAG may be bonded together to form a ring.

2. A silver halide photographic material as in claim 1, wherein $R^1$ and $R^2$ in the formula (I) each represents an alkyl group, an aryl group, a heterocyclic group, an acyl group, an alkoxycarbonyl group, a carbamoyl group, a sulfonyl group, an aryloxycarbonyl group or a sulfamoyl group, which may optionally be substituted.

3. A silver halide photographic material as in claim 1, wherein the compound of the formula (I) is a compound having the general formula (II):

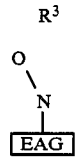

(II)

in which $R^3$ is bonded to the nitrogen atom and the oxygen atom in the formula and represents an atomic group necessary for forming a 3-membered to 8-membered mono- or condensed heterocyclic ring; and $R^3$ may also be bonded to EAG to form a ring; and the rest of the symbols have the same meanings as in the formula (I).

4. A silver halide photographic material as in claim 3, wherein the compound of the formula (II) is selected from compounds of the following formulae:

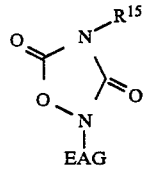

II-1

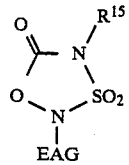

II-2

-continued

II-3

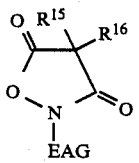

II-4

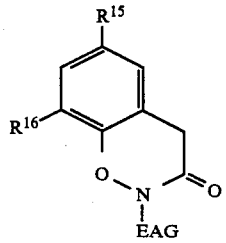

II-5

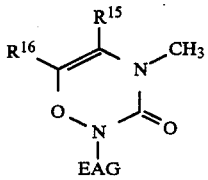

II-6

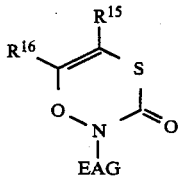

II-7

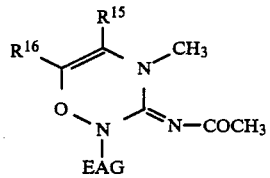

II-8

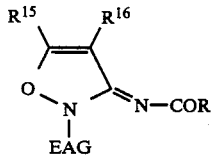

II-9

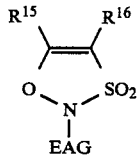

II-10

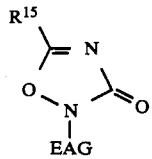

-continued

II-11

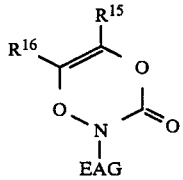

II-12

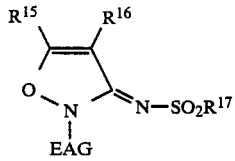

II-13

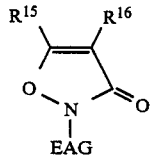

in which $R^{15}$, $R^{16}$ and $R^{17}$ may be the same or different and each represents a hydrogen atom, an aliphatic group, an aromatic group, an acyl group, an alkoxycarbonyl group, a carbamoyl group, a sulfonyl group, an aryloxycarbonyl group, a sulfamoyl group, a cyano group, a nitro group, a halogen atom, an amino group, an alkoxy group, an aryloxy group, a hydroxyl group, a ureido group, an aminocarbonyloxy group, an alkoxycarbonylamino group, an amido group, a sulfo group, a carboxyl group, a sulfonamido group, an acyloxy group or an aryloxycarbonylamino group.

5. A silver halide photographic material as in claim 3, wherein the compound of the formula (II) is a compound having the general formula (III):

(III)

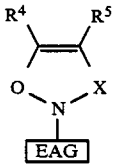

in which EAG has the same meaning as mentioned above; X represents a divalent linking group; $R^4$ and $R^5$ each represents a hydrogen atom or a substitutable group, or they may be linked together to form a saturated or unsaturated carbon ring or hetero ring.

6. A silver halide photographic material as in claim 5, wherein X represents —CO— or —$SO_2$—.

7. A silver halide photographic material as in either of claim 5 or 6, wherein $R^4$ and $R^5$ in the formula (III) each represents a hydrogen atom, a substituted or unsubstituted alkyl group, a substituted or unsubstituted aryl group, a substituted or unsubstituted heterocyclic group, an acyl group, an alkoxycarbamoyl group, a carbamoyl group, a sulfonyl group, an aryloxycarbonyl group, a sulfamoyl group, a cyano group, a nitro group, a halogen atom, an amino group, an alkoxy group, an aryloxy group, a hydroxyl group, a ureido group, an aminocarbonyloxy group, an alkoxycarbonylamino group, an amido group, a sulfo group or a salt thereof, a carboxyl group or a salt thereof, a sulfonamido group, an acyloxy group or an aryloxycarbonylamino group.

8. A silver halide photographic material as in either of claim 5 or 6, wherein $R^4$ and $R^5$ together form a condensed ring as represented by any one of the following formulae:

III-1

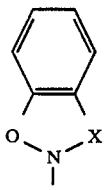

III-2

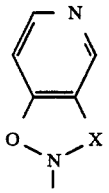

III-3

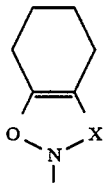

-continued

III-4

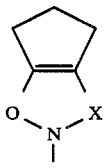

9. A silver halide photographic material as in claim 1, which contains the compound of the formula (I) in the silver halide emulsion layer and/or the hydrophilic colloid layer as provided above or below said emulsion layer in an amount of from $1\times10^{-7}$ to $1\times10^{3}$ mol per mol of the silver halide.

10. A silver halide photographic material as in claim 1, wherein the compound of the formula (I) is added to the material in an amount of from $1\times10^{-5}$ to $8\times10^{-1}$ mol per mol of the silver halide.

11. A silver halide photographic material as in claim 1, wherein the compound of the formula (I) is added to the color-sensitive layer(s) of the material in an amount of from 0.1 to 50 mol % of the coupler in the layer.

12. A silver halide photographic material as in claim 11, wherein the compound of the formula (I) is added to the color-sensitive layer(s) of the material in an amount of from 0.3 to 15 mol % of the coupler in the layer.

13. A silver halide photographic material as in claim 1 wherein the compound of the formula (I) is added to the silver halide layer(s) of the material in an amount of from $1\times10^{-6}$ to $1\times10^{-1}$ mol per mol of the silver halide.

14. A silver halide photographic material as in claim 13, wherein the compound of the formula (I) is added to the silver halide layer(s) of the material in an amount of from $1\times10^{-5}$ mol to $5\times10^{-2}$ mol per mol of the silver halide.

* * * * *